US005516451A

United States Patent [19]

Schmitt et al.

[11] Patent Number: 5,516,451

[45] Date of Patent: May 14, 1996

[54] MIXTURES OF ALKOXYLATES AS FOAM-SUPPRESSING COMPOSITION AND THEIR USE

[75] Inventors: Norbert Schmitt, Burgkirchen; Manuela Hingerl, Tüßling, both of Germany

[73] Assignee: Hoechst Aktiengesellschaft, Germany

[21] Appl. No.: 508,294

[22] Filed: Jul. 27, 1995

[30] Foreign Application Priority Data

Jul. 29, 1994 [DE] Germany ..... 44 26 889.0

[51] Int. Cl.[6] ..... C11D 01/722; C11D 3/30

[52] U.S. Cl. ..... 252/174.21; 252/174.19; 252/174.22; 252/544

[58] Field of Search ..... 252/174.19, 174.21, 252/174.22, 544

[56] References Cited

U.S. PATENT DOCUMENTS

| | | | |
|---|---|---|---|
| 4,332,692 | 6/1982 | Payne et al. | 252/135 |
| 4,539,145 | 9/1985 | Alvarez | 252/542 |
| 4,683,008 | 7/1987 | Betts | 134/27 |
| 4,780,237 | 10/1988 | Schmid et al. | 252/174.22 |
| 4,822,854 | 4/1989 | Ciolino | 252/174.19 |
| 4,965,014 | 10/1990 | Jeschke et al. | 252/174.22 |
| 5,149,456 | 9/1992 | Concannon et al. | 252/174.25 |
| 5,292,448 | 3/1994 | Klugkist | 252/174.12 |
| 5,376,298 | 12/1994 | Michael | 252/153 |
| 5,415,813 | 5/1995 | Misselyn et al. | 252/547 |

FOREIGN PATENT DOCUMENTS

| | | |
|---|---|---|
| 2204321 | 9/1988 | United Kingdom . |
| WO91/09925 | 7/1991 | WIPO . |
| WO92/14808 | 9/1992 | WIPO . |

*Primary Examiner*—Paul Lieberman
*Assistant Examiner*—Gregory R. Delcotto
*Attorney, Agent, or Firm*—Connolly & Hutz

[57] ABSTRACT

The mixtures according to the invention essentially comprise A) at least one fatty alcohol ethoxylate-propoxylate and B) at least one fatty amine and/or fatty amine ethoxylate. They have an unexpectedly high foam inhibition capacity and are particularly suitable for aqueous cleaning liquors for mechanical cleaning of hard surfaces.

4 Claims, No Drawings

MIXTURES OF ALKOXYLATES AS FOAM-SUPPRESSING COMPOSITION AND THEIR USE

DESCRIPTION

The invention relates to mixtures of alkoxylates as foam-suppressing composition and their use in cleaning liquors.

Mechanical cleaning processes are used above all for cleaning hard surfaces, such as bottles of plastic or glass, crockery of porcelain, ceramic, glass or plastic and other objects of these materials or also metals. While only relatively low liquor movements are necessary in domestic dishwashers, corresponding to the low throughput of goods to be cleaned, commercial and in particular industrial cleaning units operate at a high throughput with very high liquor movements and spray intensities. To guarantee rapid detachment and emulsification of the adhering contamination, aqueous alkaline or acid cleaning liquors are usually employed in commercial and in particular in industrial cleaning units. Because of the high mechanical liquor movements, the system must be as low as possible in foam or foam-free, since excessive foam formation can lead to disturbances in the operating performance of the unit, thus, for example, if the dirt which collects in the foam layer cannot be discharged adequately. Additional tendencies to form foam are caused by the contamination entrained into the liquor by the goods to be cleaned, in particular by protein-containing residues on the goods to be cleaned. In the case of cleaning bottles, this also applies in particular to the labels to be removed, through which size residues and residues of printing inks, including the surfactant auxiliaries contained in the latter, are introduced into the cleaning liquor.

It has already been known for a long time to employ nonionic surfactants as foam-suppressing (foam-inhibiting) agents in aqueous cleaning liquors. These are, in particular, addition products of ethylene oxide and/or propylene oxide on amines, long-chain fatty alcohols or alkylphenols, polyglycol ether formals or acetals or block copolymers of ethylene oxide and propylene oxide. Such surfactant systems can be adjusted to as low as possible a tendency to foam and increased cleaning action by suitable variation of the ethylene oxide and propylene oxide contents, a predominance of propylene oxide promoting the former property and a predominance of ethylene oxide promoting the latter property. However, such adjustment of these properties is always a compromise, and it would be desirable to obtain more of one property without having to dispense with portions of the other. A low degree of foaming of the cleaning liquors (cleaning baths) is required above all for trouble-free operation—as mentioned above—in mechanical cleaning processes for bottles, crockery and the like in the industrial sector, which proceed with high mechanical agitation.

In the recent publications WO 91/09925 and WO 92/14808, mixtures of alkoxylates are described as foam inhibitors for mechanical cleaning of hard surfaces. The composition described in WO 91/09925 essentially comprises at least one fatty alcohol ethoxylate having 2 to 12 ethylene oxide units and at least one fatty alcohol ethoxylate-propylate having 2 to 10 ethylene oxide units and 2 to 8 propylene oxide units in a weight ratio of 10:1 to 1:10, and that according to WO 92/14808 comprises two fatty alcohol ethoxylate-propoxylates in a weight ratio of 10:90 to 90:10, one fatty alkyl radical having 8 to 18 carbon atoms and the other 10 to 20 carbon atoms, with the proviso that the two fatty alkyl radicals differ in average number of carbon atoms by at least 0.5. These mixtures based solely on fatty alcohol alkoxylates also leave something to be desired, especially in respect of foaming properties.

It has now been found that certain combinations of fatty alcohol ethoxylate-propoxylates and fatty a mines or fatty amine ethoxylates have an unexpectedly high foam-suppressing action.

The mixtures according to the invention essentially comprise

A) 10 to 90% by weight, preferably 70 to 90% by weight, of at least one fatty alcohol ethoxylate-propoxylate of the formula I $$R^1—O—(C_2H_4O)_x—(C_3H_6O)_y—H \quad (I)$$

in which $R^1$ is an alkyl radical or an alkenyl radical having 6 to 22 carbon atoms, preferably 8 to 18 carbon atoms, x is a number from 1 to 10, preferably from 2.5 to 5, and y is a number from 1 to 10, preferably from 3 to 6, and B) 10 to 90% by weight, preferably 10 to 30% by weight, of at least one fatty amine or fatty amine ethoxylate, or of a mixture thereof, of the formula II $$R^2—N\begin{matrix}(C_2H_4O)_m—H \\ (C_2H_4O)_n—H\end{matrix} \quad (II)$$

in which $R^2$ is an alkyl radical or an alkenyl radical having 6 to 22 carbon atoms, preferably 8 to 18 carbon atoms, and m+n is a number from 0 to 10, preferably from 2 to 8, percentages by weight based on the mixture.

The following may also be stated regarding components A) and B) to be employed according to the invention: The alkyl radicals and alkenyl radicals $R^1$ and $R^2$ can be straight-chain or branched, straight-chain radicals being preferred. The alkenyl radicals preferably have 1 to 3 double bonds. The numbers given for x, y and m plus n are statistical means (average values), i.e. x, y, m and n can each be an integer or a fraction. Component A) is thus a reaction product of a fatty alcohol with initially x mol of ethylene oxide and then y mol of propylene oxide, which can be of the type $—CH_2—CH(CH_3)O—$ or $—CH(CH_3)—CH_2O—$ the latter being preferred. Component B) is a fatty amine (primary amine) with the alkyl or alkenyl groups mentioned, or preferably a reaction product of such a fatty amine with m+n mol of ethylene oxide. The fatty amine ethoxylates according to formula II are thus preferred as component B). Examples of alkyl and alkenyl radicals in formula I and II are n-hexyl, n-heptyl, n-octyl, 2-ethylhexyl, iso-nonyl, n-decyl, iso-decyl, n-dodecyl, stearyl, n-eikosyl, oleyl, coconut alkyl and tallow alkyl, as well as alkyl or alkenyl mixtures, for example a mixture of $C_{12}$-alkyl to $C_{14}$-alkyl ($C_{12/14}$). All the compounds according to component A) and B) are known and are commercially obtainable.

The foam-suppressing compositions according to the invention are prepared simply by mixing together components A) and B) and if appropriate further expedient components and additives at a temperature of 15° to 50° C., preferably 20° to 30° C., advantageously while stirring.

The mixtures according to the invention can be employed in undiluted form, that is to say as such, or in the form of aqueous concentrates, for example for the purpose of better ease of metering, if appropriate with the addition of an organic solvent. Components A) and B) can of course also be added separately to the aqueous cleaning liquor. The use concentration in the aqueous liquors (alkaline or acid) is expediently 0.05 to 10 g of the mixture according to the invention per liter of cleaning liquor, preferably 0.1 to 2 g per liter. The use concentrations mentioned are non-critical data, since the amount depends to a certain extent on the nature of the surface to be cleaned and on the nature and extent of the contamination.

As mentioned above, further additives and auxiliaries can be added to the surfactant mixtures according to the invention for the preparation of commercially available formulations. These are, for example, dyestuffs, fragrances, corrosion inhibitors and disinfectants. The known builders, which are optionally simultaneously complexing agents, may furthermore be mentioned here. These include the condensed phosphates, such as tripolyphosphates and pentasodium triphosphate, the complexing aminopolycarboxylic acids and salts thereof, for example the alkali metal salts of nitrilotriacetic acid and of ethylenediaminetetraacetic acid, and the complexing hydroxy carboxylic acids and polymeric carboxylic acids, such as citric acid, tartaric acid and the like. Another class of complexing builders are polyphosphonic acid salts, such as, for example, the alkali metal salts of aminophosphonic acid. Finally, builders such as silicates, for example sodium metasilicate, carbonates, bicarbonates, borates and citrates, can also be added. The surfactant mixtures according to the invention can optionally be converted into powder formwith the aid of such additives and used in this form.

The mixtures according to the invention are distinguished by a high foam-suppressing action. They have an extremely low tendency to foam and foam formation tendency both at low and at elevated temperatures (for example in the range from 15° to 80° C.) and likewise also with very vigorous agitation of the liquor and the presence of foam-promoting contamination, such as protein, milk, beer, lemonade, size or other adhesives and the like. In addition, the mixtures according to the invention have a high cleaning action and a high dirt-absorbing capacity. This latter property allows long service lives in the unit until this is refilled, without impairment of the cleaning action. The good wetting capacity and draining properties allow rapid detachment of dirt and therefore a high throughput of goods to be cleaned. The absence of stains and streaks and a high shine on the cleaned goods are also ensured. The mixtures according to the invention are also resistant to alkali and acids and are stable to storage together with these over long periods of time.

The surfactant mixtures according to the invention are suitable for suppressing foam in cleaning liquors quite generally. They are particularly suitable for alkaline liquors for mechanical cleaning of hard surfaces, thus, for example, for liquors in domestic dishwashers and in commercial cleaning units. They are suitable above all in the case of industrial cleaning units for hard surfaces, such as crockery and bottle washing units, which operate with aqueous alkaline liquors under high mechanical agitation of the liquor in continuous operation, where the pH values can be a $\geqq 10$ or $\geqq 12$ (highly alkaline liquors). Another example which may be mentioned is the cleaning of bottles of glass or plastic (preferably polyester, such as polyethylene terephthalate) in breweries, problem-free discharge of the detached labels being possible because of the substantial absence of foam, and furthermore it being ensured that no impairment due to collapse of the foam occurs when the cleaned bottles are filled with the foaming beer. As is known, alkaline cleaning liquors essentially comprise 95 to 99% by weight of water and 1 to 5% by weight of sodium hydroxide and/or potassium hydroxide. The composition according to the invention is also suitable for aqueous acid cleaning liquors, which as is known essentially comprise 50 to 80% by weight of water and 20 to 50% by weight of, preferably, phosphoric acid or sulfuric acid.

The invention is explained in still more detail by the following examples and comparison examples (EO=ethylene oxide and PO=propylene oxide).

EXAMPLE 1

70% by weight of an alkoxylate of the formula $R^1$—O—$(C_2H_4O)_2$—$(C_3H_6O)_4$—H, in which $R^1$ is $C_{12/14}$-alkyl (expressed in abbreviated form: $C_{12/14}$-alcohol+2 EO+4 PO) and 30% by weight of a coconut amine ethoxylate with 8 mol of ethylene oxide (expressed in abbreviated form: coconut amine+8 EO).

EXAMPLE 2

80% by weight of $C_{12/15}$-alcohol+5 EO+5 PO
20% by weight of oleylamine+2 EO

EXAMPLE 3

80% by weight of $C_{12/14}$-alcohol+3 EO+4.5 PO
20% by weight of stearylamine+8 EO

EXAMPLE 4

70% by weight of $C_{10/12}$-alcohol+4 EO+4 PO
20% by weight of coconut amine+2 EO Comparison Example 1 (According to WO 91/09925)

50% by weight of $C_{12/14}$-alcohol+4 EO
50% by weight of $C_{12/14}$-alcohol+3.6 EO+5 PO Comparison Example 2 (According to WO 91/09925)

50% by weight of $C_{12/16}$-alcohol+7 EO
50% by weight of $C_{12/14}$-alcohol+2 EO+4 PO Comparison Example 3 (According to WO 91/09925)

66.5% by weight of $C_{12/14}$-alcohol+5.6 EO+4 PO
33.5% by weight of $C_{11}$-alcohol+5 EO Comparison Example 4 (According to WO 92/14808)

50% by weight of $C_{12/14}$-alcohol+4 EO+4 PO
50% by weight of $C_{12/15}$-alcohol+5 EO+5 PO Comparison Example 5 (According to WO 92/14808)

50% by weight of $C_{12/14}$-alcohol+5.6 EO+4 PO
50% by weight of $C_{12/15}$-alcohol+5 EO+5 PO The components mentioned in the examples and comparison examples were mixed together at room temperature, while stirring. The mixtures according to the invention and mixtures of the prior art thus obtained were tested in respect of foaming properties. Testing was carried out in accordance with DIN 53 902 (DIN=Deutsche Industrienorm) [German Industrial Standard]) at 15° and 65° C. For this, 0.3 g of the mixture was dissolved in 1 liter of completely desalinated water. 200 ml of this solution were introduced into a 1000 ml measuring cylinder and beaten 30 times with a perforated beating disk. The foam height formed in the measuring cylinder, expressed in milliliters, is the foam value of the mixture. The results are summarized in the following table:

TABLE

| Mixtures of | Foaming properties 15° C. | 65° C. |
|---|---|---|
| Examples | | |
| 1 | 60 ml | 0 ml |
| 2 | 60 ml | 0 ml |
| 3 | 60 ml | 0 ml |
| 4 | 70 ml | 0 ml |
| Comparison examples | | |
| 1 | 80 ml | 20 ml |
| 2 | 80 ml | 20 ml |
| 3 | 110 ml | 10 ml |
| 4 | 110 ml | 0 ml |
| 5 | 100 ml | 10 ml |

As the results of the examples and comparison examples show, the mixtures according to the invention have an unexpectedly low foam value. Because of their extremely low foam values and their other advantageous properties, the mixtures according to the invention are excellent additives in particular to cleaning liquors for cleaning hard surfaces.

We claim:

1. A mixture of alkoxylates as a foam-suppressing composition, consisting essentially of A) 10 to 90% by weight, of at least one fatty alcohol ethoxylate-propoxylate of the formula I $$R^1—O—(C_2H_4O)_x—(C_3H_6O)_y—H \quad (I)$$

in which $R^1$ is an alkyl radical or an alkenyl radical having 6 to 22 carbon atoms, x is a number from 1 to 5, and y is a number from 1 to 6, and B) 10 to 90% by weight, of at least one fatty amine or fatty amine ethoxylate, or of a mixture thereof, of the formula II

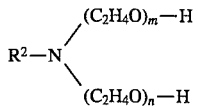

(II)

in which $R^2$ is an alkyl radical or an alkenyl radical having 6 to 22 carbon atoms, and m+n is a number from 2 to 10, the percentages by weight being based on the mixture.

2. A mixture as claimed in claim 1, in which component A) is present in an amount of 70 to 90% by weight and component B) is present in an amount of 10 to 30% by weight.

3. A mixture as claimed in claim 1, in which, in formula I, $R^1$ is an alkyl radical or an alkenyl radical having 8 to 18 carbon atoms, x is a number from 2.5 to 5 and y is a number from 3 to 6, and in formula II, $R^2$ is an alkyl radical or an alkenyl radical having 8 to 18 carbon atoms and m plus n is a number from 2 to 8.

4. A mixture as claimed in claim 2, in which, in formula I, $R^1$ is an alkyl radical or an alkenyl radical having 8 to 18 carbon atoms, x is a number from 2.5 to 5 and y is a number from 3 to 6, and in formula II, $R^2$ is an alkyl radical or an alkenyl radical having 8 to 18 carbon atoms and m plus n is a number from 2 to 8.

* * * * *